United States Patent [19]

Baldi

[11] 4,208,453

[45] Jun. 17, 1980

[54] MODIFIED DIFFUSION COATING OF THE INTERIOR OF A STEAM BOILER TUBE

[75] Inventor: Alfonso L. Baldi, Wynnewood, Pa.

[73] Assignee: Alloy Surfaces Company, Inc., Wilmington, Del.

[21] Appl. No.: 752,855

[22] Filed: Dec. 21, 1976

Related U.S. Application Data

[63] Continuation-in-part of Ser. No. 694,951, Jun. 11, 1976, abandoned, and Ser. No. 614,834, Sep. 19, 1975, Pat. No. 4,140,760, and Ser. No. 579,945, May 22, 1975, abandoned, said Ser. No. 614,834, and Ser. No. 579,945, each is a continuation-in-part of Ser. No. 304,220, Nov. 6, 1972, Pat. No. 3,936,539, Ser. No. 357,616, May 3, 1973, Pat. No. 3,948,687, Ser. No. 404,665, Oct. 9, 1973, Pat. No. 3,948,689, Ser. No. 446,473, Feb. 27, 1974, Pat. No. 3,958,046, and Ser. No. 446,908, May 3, 1974, Pat. No. 3,958,047, said Ser. No. 304,220, Ser. No. 357,616, Ser. No. 404,665, and Ser. No. 446,473, each is a continuation-in-part of Ser. No. 219,514, Jan. 20, 1972, Pat. No. 3,801,357, said Ser. No. 304,220, Ser. No. 357,616, and Ser. No. 404,665, each is a continuation-in-part of Ser. No. 254,403, May 18, 1972, Pat. No. 3,785,854, and Ser. No. 90,682, Nov. 18, 1970, Pat. No. 3,764,371, said Ser. No. 254,403, is a continuation-in-part of Ser. No. 219,514, , and Ser. No. 90,682, , said Ser. No. 219,514, is a continuation-in-part of Ser. No. 90,682, and Ser. No. 837,811, Jun. 30, 1969, abandoned, said Ser. No. 90,682, is a continuation-in-part of Ser. No. 837,811, , abandoned.

[51] Int. Cl.[2] ..... C23C 11/04

[52] U.S. Cl. ..... 427/237; 427/239; 427/253; 138/145; 106/1.12; 106/1.22; 252/466 R

[58] Field of Search ..... 427/253, 252, 237, 239, 427/230, 235, 181; 138/145

[56] References Cited

U.S. PATENT DOCUMENTS

| | | | |
|---|---|---|---|
| 3,096,160 | 7/1963 | Puyear | 427/253 |
| 3,163,553 | 12/1964 | Commanday et al. | 427/253 |
| 4,043,945 | 8/1977 | Fukui et al. | 252/466 J |

FOREIGN PATENT DOCUMENTS

| | | | |
|---|---|---|---|
| 603313 | 6/1948 | United Kingdom | 427/239 |
| 633701 | 12/1949 | United Kingdom | 427/252 |

OTHER PUBLICATIONS

Powell et al., Vapor Plating, John Wiley & Sons, (1955), p. 48.

*Primary Examiner*—Ralph S. Kendall
*Attorney, Agent, or Firm*—Connolly and Hutz

[57] ABSTRACT

Diffusion coatings can be masked from portions of a workpiece by combination of layers, the outer one of which forms coherent strong shell that holds inner layer or layers in place. All ingredients of these layers can be materials such as nickel, nickel aluminide, chromium, chromic oxide ($Cr_2O_3$) and inert diluent that do not contaminate superalloys or even low alloy or plain carbon steels. Such a holding shell can also be used to retain on a workpiece surface a layer that causes formation of a diffusion coating. Low alloy steel conduit can be internally chromized and/or externally chromized or aluminized to make it more desirable for use as high pressure steam boiler heat exchange tubing. Nickel articles aluminized with deep $Ni_2Al_3$ layer that has outer skin more heavily aluminized can have aluminum correspondingly leached out from outer skin only.

7 Claims, No Drawings

MODIFIED DIFFUSION COATING OF THE INTERIOR OF A STEAM BOILER TUBE

The present application is a continuation-in-part of application Ser. Nos. 694,951 filed June 11, 1976, (subsequently abandoned), 614,834 filed Sept. 19, 1975 (U.S. Pat. No. 4,140,760 granted Feb. 27, 1979), and 579,945 filed May 22, 1975, (subsequently abandoned) the latter two of which are each continuations-in-part of applications Ser. Nos. 304,220 filed Nov. 6, 1972 (U.S. Pat. No. 3,936,539 granted Feb. 3, 1976); 357,616 filed May 3, 1973 (U.S. Pat. No. 3,948,687 granted Apr. 6, 1976); 404,665 filed Oct. 9, 1973 (U.S. Pat. No. 3,948,689 granted Apr. 6, 1976); 446,473 filed Feb. 27, 1974 (U.S. Pat. No. 3,958,046 granted May 18, 1976); and 466,908 filed May 3, 1974 (U.S. Pat. No. 3,958,047 granted May 18, 1976). Ser. Nos. 304,220, 357,616, 404,665 and 446,473 are in turn continuations-in-part of application Ser. No. 219,514 filed Jan. 20, 1972 (U.S. Pat. No. 3,801,357 granted Apr. 2, 1974); Ser. Nos. 304,220, 357,616 and 404,665 are continuations-in-part of applications Ser. Nos. 254,403 filed May 18, 1972 (U.S. Pat. No. 3,785,854 granted Jan. 15, 1974) and 90,682 filed Nov. 18, 1970 (U.S. Pat. No. 3,764,371 granted Oct. 9, 1973); Ser. No. 254,403 is a continuation-in-part of applications Ser. Nos. 219,514 and 90,682; Ser. No. 219,514 is a continuation-in-part of applications Ser. Nos. 90,682 and 837,811 filed June 30, 1969 (subsequently abandoned); and Ser. No. 90,682 is a continuation-in-part of application Ser. No. 837,811.

The present invention relates to the coating of metals to increase their resistance to corrosion and other chemical attacks.

Among the objects of the present invention is the provision of novel coating techniques and compositions for use therewith, as well as novel coated products, all suitable for commercial operations.

Additional objects of the present invention include compositions and techniques for confining protective diffusion coatings to desired locations on workpieces such as jet engine components to be protected by the coatings.

Ser. No. 694,951 describes the diffusion aluminizing of objects such as rotor blades and vanes of a turbine engine, and the masking of portions such as the roots or buttresses of these blades and vanes to keep those portions from the dimensional growth caused by such aluminizing.

The disclosure of Ser. No. 694,951 is incorporated in the present specification as though fully set forth herein. As there pointed out, a particularly desirable masking technique involves the coating of the portions to be masked with at least one layer of a dispersion of finely divided depletion-reducing masking solid and resin in a volatile solvent, evaporating off sufficient solvent to set the coating, applying over the set coating at least one stratum of finely divided non-contaminating solid particles that upon aluminizing become coherently held together to form a secure masking sheath.

The sheath-forming layer or one or more of the strata which constitute this layer, preferably have $Cr_2O_3$, nickel or mixtures of these two, as the particles that become coherently united by the aluminizing. Neither of these materials contaminate superalloy or stainless steel workpieces inasmuch as only chromium or nickel can be introduced into the workpieces from these sources, and these two metals are already present in the workpieces. Chromium and nickel are also not considered contaminants for low alloy steels, particularly those ferrous alloys containing at least 1% chromium.

The $Cr_2O_3$ and nickel particles are so actively effective that they can be diluted with as much as twice their weight of alumina or other inert filler, without losing their sheath-forming ability. While they can be used in undiluted form, it is preferred to dilute these aluminizable ingredients with some filler, at least about half as much filler as active material, by weight. Such dilution diminishes the amount of material that can consume the aluminizing aluminum, and also reduces the masking cost. Moreover undiluted coatings of $Cr_2O_3$ and resin tend to crack on drying. $Cr_2O_3$ is also not a good shell former for pack chromizing.

For best masking of diffusion coatings that are applied at extremely high temperatures, e.g. 1900° F. or higher, it is helpful to have the masked surface only in contact with an essentially inert layer such as inert diluent, or inert diluent mixed with a small amount, not over about 5% of depletion-preventing material such as powdered chromium. This depletion-preventing material helps keep chromium and other key alloying ingredients of the masked surface from diffusing out of that surface. Such an essentially inert surface-contacting layer is also helpful in the masking of aluminum diffusions that are conducted at temperatures as low as 1100° F.

The most elaborate masking arrangement of the present invention uses a three-layer masking combination in which the workpiece-contacting layer is of the essentially inert type, the next layer of the masking type, and the outermost layer of the sheath-forming type. Nickel aluminides present in any masking layer other than a sheath-forming layer, should have no more than about 3 atoms of aluminum for every four atoms of nickel.

A feature of the present invention is that the masking materials are conveniently marketed as a kit of chemicals. Such a kit can for instance consist of a container holding a quantity of inert layer mixture, a second container holding masking layer mixture, another container or two holding sheath-forming mixture of mixtures, a further container holding a solution of the resin in the volatile solvent, and if desired a still further container holding extra solvent.

To make the masking layers easier to apply, it is helpful to add to the resin solution a little long-chain-hydrocarbon acid such as stearic acid that helps keep the particles of the masking composition dispersed in the volatilizable organic solvent in which they are suspended. As little as about 0.1% of such dispersing aid based on the total weight of the suspension, is enough to impart very good flowability so that the painting, or even dipping of the workpieces, is simpler and produces a more uniform masking layer. However dispersing aid concentrations of at least about 0.3% to about 0.5% are preferred, and as much as 1% can be effectively used.

Hydrocarbon chain lengths as short as 12 carbons and as long as 50 carbons or more are suitable for the dispersing aid. Thus lauric acid, myristic acid, oleic acid, and even copolymers of ethylene and acrylic acid, are effective. The dispersing aid should also be soluble in the solvent in which the masking composition is suspended.

The effectiveness of the dispersing aid is increased by also dissolving in the suspension a small amount of a surface-active agent, preferably a low-foaming nonionic surface-active agent such as polyethoxy ether of a linear primary alcohol like cetyl alcohol, or of an alkyl phenol. Only about 0.1% of surface-active agent is all that is needed. It should be noted in this connection that the surface-active agent when added without the long-chain-hydrocarbon acid, has substantially no effect on the masking suspension.

The masking suspension of the present invention can be used to prevent chromizing or to prevent aluminizing. The nickel and/or nickel aluminide in the masking layers combines with either chromium or aluminum or both and in this way prevents significant penetration of either of these metals to the workpiece surface on which the masking is applied.

The essentially inert layer of the masking combination need only weigh about $\frac{1}{8}$ gram per square centimeter to improve the masking action by preventing roughening of the workpiece surface being masked. That layer can also weigh as much as about 2 grams per square centimeter, and can be composed of inert materials such as alumina, kaolin or MgO. The presence of about $\frac{1}{2}$ to about 5% chromium metal in the essentially inert layer or in the layer above it, contributes a strong depletion-reducing effect.

The following illustrates such a masking technique.

EXAMPLE 1

A group of hot section turbine engine blades of U-520 alloy (0.05% C, 19% Cr, 12% Co, 6% Mo, 1% W, 3% Ti, 2% Al, 0.005% B, the balance Ni) have their roots masked by dipped coating of three superimposed layers as follows:

first layer—a slurry of 2300 grams of 10 to 20 micron particles of alumina in 1300 grams (1000 cc) of a 7% solution of poly(ethylmethacrylate) in methyl chloroform containing 0.5% stearic acid. Three dips are used to provide a layer containing about 350 milligrams of non-volatiles per square centimeter of surface, and the layer is then permitted to dry by exposure to the atmosphere for about 20 seconds.

second layer—a slurry of 20 to 50 micron particles of $Ni_3Al$, similarly sized particles of Cr and 10 to 20 micron particles of alumina in the foregoing methyl chloroform solution of resin and stearic acid. The slurry contains 50 grams $Ni_3Al$, 5 grams Cr and 45 grams alumina for every 50 cc. of the foregoing solution, and two dips are used to provide about 400 milligrams of non-volatiles per square centimeter of surface. This layer is then permitted to dry.

third layer—a slurry of 20 to 50 micron particles of Ni, similarly sized particles of $Ni_3Al$ and 10 to 20 micron particles of alumina, suspended in the foregoing methyl chloroform solution of resin and stearic acid. The slurry contains 75 grams Ni, 13 grams $Ni_3Al$ and 12 grams $Al_2O_3$ for every 33 cc. of the foregoing solution, and is brushed on to deposit a layer thickness containing about 600 milligrams of non-volatiles per square centimeter of surface. The resulting layer is also permitted to dry.

The slurries are shaken before dipping and before the brushes used for brushing are dipped into them. A little shaking keeps the slurries well dispersed for the few minutes needed to do the dipping or brushing, and each brush stroke applies a uniform slurry stratum that can be built up to the desired total layer thickness by an overlying brush stroke or two. Expert brush manipulation is not necessary.

The vanes with the dried three-layer masking on their roots are then packed in a chromizing powder pack in a plain carbon steel retort. An effective pack for this purpose is composed of a previously broken-in mixture of 40% Cr powder 1 to 10 microns in size, 59.5% alumina 10 to 20 microns in size, and 0.5% $NH_4Cl$ powder. The pack is broken in by heating it for 10 hours at 2050° F. under hydrogen in a retort without a workpiece, and then, after cooling, adding a fresh 0.5% $NH_4Cl$ to make up for the driving off of the original $NH_4Cl$ during the break-in.

The retort loaded with the masked blades packed in the chromizing pack, is then placed in an outer retort through which a protective gas is passed as described in U.S. Pat. No. 3,785,854, and subjected to diffusion heat treatment bathed in hydrogen, the pack temperature reaching 2050° F. where it is held for ten hours. A thermocouple embedded in the pack at a location into which the heat penetrates with greatest difficulty, is used to show the temperature.

After the packed retort has cooled down sufficiently it is removed from the outer retort and the workpiece unpacked. The masking is then in the form of a hard crack-free shell locked around each blade root. Striking this shell with a wooden mallet or rods breaks the shell into small pieces that do not adhere to the workpiece, and drop off revealing a smooth bright root surface free of chromized case. The balance of the blade shows a good chromized case 4 mils deep.

Similar results are obtained with other chromizing packs and using diffusion coating temperatures as high as 2200° F. and as low as 1550° F. The same three-layer masking combination is also suitable for masking the blades against diffusion aluminizing, and even at aluminizing temperatures as low as 900° F. such combination forms the hard shell that remains in place and keeps the masking from significantly contaminating the surrounding diffusion-coating pack.

Such hard shell protection is also formed when the first of the three masking layers, that is the essentially inert layer, is omitted, but the masked workpiece surface is then apt to be not quite as smooth and bright, particularly when the diffusion coating is effected at very high temperatures. With or without the essentially inert layer, at least about 50 milligrams of $Ni_3Al$ or similar nickel aluminide per square centimeter of masked surface assures the most effective masking, and this can be applied with or without the metallic chromium, and with or without the alumina or other inert diluent in the masking layer. When used without the chromium and without the foregoing first layer, some loss of chromium takes place from masked superalloy surfaces. Without its inert diluent the masking layer becomes more expensive unless its thickness is reduced so that more care is needed to assure its proper application.

In general, a slurry used to apply a masking layer should have at least about 20 volume percent and up to about 70 volume percent suspended solids.

For diffusion aluminizing at temperatures below about 1100° F. or diffusion chromizing at temperatures below 1900° F., masking is very effectively provided without the first layer and without significant roughening of the masked surface. When masking workpiece surfaces of cobalt or cobalt-base alloys, cobalt aluminides can be used in place of nickel aluminides.

In general, the masking layer should contain powdered nickel or powdered nickel aluminide or powdered cobalt aluminide, preferably diluted so that it constitutes up to about 90% of the layer, and at least about 25% of the layer, by weight. However, for masking superalloys, where depletion is to be avoided, elemental nickel should not be used in a layer contacting the masked surface or having only an essentially inert layer between it and the masked surface. In such use the masking ingredient should be a nickel or cobalt aluminide having between $\frac{1}{3}$ and $\frac{3}{4}$ atom of aluminum for every atom of nickel or cobalt.

Similarly a sheath-forming layer can have a nickel or $Cr_2O_3$ content of from about 50 to about 100%, and when it contains nickel can also contain aluminum in an amount up to equiatomic with the nickel.

The foregoing percentages do not take into account the resin bonding agent and the like that holds the layers in place but is driven off during the diffusion coating.

The second of the masking layers of Example 1 can be omitted and only the first and third layers used when masking against aluminizing and particularly when aluminizing stainless or low alloy steels.

The sheath-forming layer can be used as a very effective mask without any other helping layers, when aluminizing at temperatures below 1100° F. Sheath formation seems to be caused by the sintering together of the nickel particles in the third masking layer, under the influence of the diffusion atmosphere which causes diffusing metal to diffuse into the nickel of these particles. These particles thus grow in size. The $Cr_2O_3$ particles appear to form some chromium metal that becomes aluminized and sinters to a sheath.

Sheath formation can also be effected by adding to the sheath-forming layer a metal powder like aluminum the particles of which sinter to the nickel particles. Excessive addition is to be avoided to keep the added metal from contaminating the workpiece. Thus an aluminum addition of this type should contribute no more than about one atom of aluminum for every atom of nickel. As little as one one-hundredth of that proportion of aluminum helps the sheath formation, particularly where only a light diffusion is being performed.

The sheath-forming layer can be used to lock masking mixtures about a workpiece surface by partially or completely enveloping that surface. However such sheath formation will also securely hold a masking mixture against a portion of a flat or concave workpiece surface, particularly when such a combination is embedded in a powder pack in a diffusion coating retort.

Other inert diluents such as kaolin or MgO can be substituted for some or all the alumina in each of the foregoing formulations.

It is convenient to have a kit of masking materials for selective use as needed. Thus one such general utility kit contains separately packaged the inorganic ingredients or ingredient mixtures of the three masking layers of Example 1, along with a separate quantity of the methyl chloroform solution and a separate quantity of methyl chloroform make-up to replenish slurries that have lost excessive solvent through evaporation. The appropriate inorganic ingredients can then be selected and added to the methyl chloroform solution to make any or all of the foregoing layer-forming slurries.

For special situations, one or more of the foregoing ingredient units can be omitted from a kit.

The fragments of sheath broken away from the workpiece after the diffusion coating is completed, can contain large quantities of nickel, and such nickel can be recovered from the fragments, if desired, as by dissolving it out in acid and separating the dissolved nickel from dissolved aluminum by ammoniacal precipitation of the aluminum. Alternatively, the fragments can be crushed into powder, their inert diluent such as alumina separated from the crushed powder by dropping that powder through a horizontally moving airstream that deflects the less dense diluent more than the more dense metal, melting the resulting metal with sufficient freshly added aluminum or nickel to convert the melt to $Ni_3Al$ for reuse as such.

Omitting the stearic acid from the slurries used to apply the masking layers makes it more difficult to keep the slurries uniformly suspended and calls for the slurries to be shaken frequently to reduce settling.

Using the first and/or second masking layers without the third layer causes the applied masking layer or layers to develop cracks and gaps during the diffusion heating as a result of the thermal driving off of the binder resin. This causes such masking to be unreliable.

Omitting the nickel from the outermost of the three layers keeps it from forming the desired protective shell, unless the omitted nickel is replaced by $Cr_2O_3$. The remaining ingredients of the outermost layer make it more generally effective and easier to apply, but are not essential.

The substitution of other acrylic resins such as poly (ethyl acrylate) or similar binder resins for the poly (ethyl methacrylate) of Example 1 does not materially change the results. Other solvents such as toluene can also be substituted for the methyl chloroform, but the methyl chloroform has a combination of non-flammability, volatility and lack of health hazard, that makes it particularly desirable.

The outermost or sheath-forming layer of the masking combination makes a very effective retaining or securing means that assures the locking of other types of layers beneath it onto the workpiece surface through the coating heat. The same securing action can be used to hold a slurry coating layer instead of a masking layer, on the workpiece. This is illustrated in the following example and makes it unnecessary to have the workpiece embedded in a coating pack.

EXAMPLE 2

A 5-foot length of steam generator high pressure tubing of Croloy alloy (1.9 to 2.6% Cr, 0.97 to 1.13% Mo, 0.15% C, balance essentially iron) having a $\frac{3}{4}$ inch bore and a $\frac{1}{2}$ inch wall was thoroughly cleaned inside and out, and had its bore filled with a chromizing pack composed of a previously broken-in mixture of

- 10% chromium powder the particle sizes of which range from about 10 to about 20 microns, and
- 90% tubular alumina granules having a particle size ranging from about 100 to about 300 microns to which mixture was added $\frac{1}{2}$% $NH_4Cl$ granules as an activator. The breaking-in was effected by a mixture of the foregoing three ingredients in a retort in the absence of a workpiece, to 1800–1850° F. for 10 hours under hydrogen. The tube so filled had its ends capped with 1010 steel caps frictionally fitted over the tube ends so as to provide semi-gas-tight covers.

The outside surface of the tube was then painted with the following layers in succession, drying the first layer for a few minutes before applying the second:

first layer—600 grams of a previously broken-in mixture of 45% Cr, 45% alumina and 10% Al, to which $\frac{1}{2}$% $NH_4Cl$ is added before as well as after break-in as described in U.S. Pat. No. 3,801,357, suspended in 200 cc of methyl chloroform solution containing 7 weight percent of a copolymer of 70% ethyl and 30% methyl methacrylates, 0.5 weight percent stearic acid and 0.1 weight percent cetyl ether of decaethoxy ethanol. Four applications of this mixture are made with intervening drying to build the non-volatile coating to 1200 milligrams per square centimeter of tube surface.

second layer—600 grams of a mixture of 68.5% Ni powder and 31.5% Al powder, dispersed in 150 cc of above methyl chloroform solution. The metals of this slurry were not pre-fired, and only two applications of this slurry was made to provide a non-volatile coating weight of about half that of the first layer.

The tube so prepared was placed in a tubular retort of a diffusion coating furnace assembly having inlet and outlet connections for a hydrogen-blanketing as in U.S. Pat. No. 3,801,357 and then subjected to a diffusion coating heat of 1800° F. for 10 hours. After cooldown at the end of the heat, the tube end caps were removed, the pack in the tube bore poured out, and the sheath around the exterior of the tube broken off and removed. The interior of the tube was effectively chromized with a case 1.8 to 2.3 mils thick, and the outside of the tube aluminized with a case about 24 mils thick.

The chromized case included an outer portion about 0.3 mil thick rich in chromium carbide, and an inner portion of columnar chromized structure. This case is particularly effective in reducing erosion of the internal tube surface by rapidly moving high pressure steam.

The aluminized outer surface prolongs the life of the tube in a coal- or oil-fired furnace where it is subjected to combustion atmospheres at temperatures as high as about 1000° F.

The internal pack is a highly fluent composition that is easily poured into place before the heat, and is readily removed afterwards, using a minimum of mechanical poking and the like. Such a pack is particularly desirable for packing of cramped recesses in the interior or workpieces, such as in the narrow bores described above, or in hollow jet engine blades, or the like.

The noted fluency is brought about because the alumina granules, which are crushed from alumina that has been melted and solidified, are quite fluent and show a flow angle of about 45 degrees. This is the angle of incline (measured from the horizontal) of a cone made by pouring a stream of the granules onto one spot to build up a cone. The fluency can be increased by selecting aluminas or other inert particles having an even smaller flow angle. Thus alumina microspheres having particles sized about 100 to about 500 microns are exceptionally fluent. Tabular alumina, which can be made by sintering alumina powder and then crushing, is also fluent, and is preferred because it tamps in place better and then during the diffusion coating does not shrink from the surface against which it is tamped.

The pack need only have about ½ its volume on any of the foregoing fluent materials. Thus the chromium particles by themselves need not be fluent at all, and will provide a suitable fluent pack when ½ of the pack is constituted by the fluent granules or microspheres. Similarly non-fluent alumina or other non-fluent inert material can be present in the pack with or without non-fluent chromium powder, without detracting significantly from the fluency provided by the foregoing volume of fluent material.

The fluent diffusion coating packs are also highly beneficial for use in chromizing bent small-bore tubing. Thus for some steam-generating arrangements lengths of steam-generating tubes have one end bent back 180 degrees to form cane-shaped units which can have their ends welded to additional lengths to form a continuous furnace tube assembly. The packing of the bores of such "canes" for diffusion coating, and the subsequent pack removal after coating, is greatly simplified by the use of fluent packs.

Any ferrous base steam boiler tubing is improved by the foregoing diffusion coatings. Plain carbon and low alloy steels will form the chromium carbide stratum with underlying columnar chromized case, and will show very little abrading loss when used with high pressure steam. Such abrasion by the steam causes the steam to carry along with it the abraded particles and they can damage the vanes and blades of turbines driven by the steam. For such pressurized use the boiler tubing should have a wall thickness of at least about 3/16 inch.

The external surfaces of boiler tubing are also made more resistant to corrosion as a result of the aluminizing or the chromizing described above, even the minor chromizing effected when only the interior of such a tube is packed with the diffusion chromizing mix.

As pointed out, the shell-forming layer used to hold a slurry coating in place where there is not much of an aluminizing or chromizing atmosphere, contains non-contaminating materials that sinter together under coating conditions. Thus nickel and aluminum powders smaller than about 500 microns in size and in an atom proportion from about 1:0.9 to about 1:1.1 are very effective. Chromium can be substituted for the nickel in such a mixture. Because of the non-contaminating character, a diffusion coating pack will not be ruined in the event a small amount of the masking materials should inadvertently become mixed into it.

Fluent diffusion coating packs are also very helpful even when they are used without insertion into cramped spaces. Thus in diffusion coating of the outer surfaces of turbine vanes or blades in the standard arrangements such as shown in U.S. Pat. No. 3,764,371 or in glass-sealed retorts as in U.S. Pat. No. 2,844,273, a fluent pack is simpler to load into a retort, simpler to embed the work in and far easier to remove from the retort after the coating heat is completed. For such use the fluent particles can have repose angles of as much as 55 degrees, and can constitute as little as about 40% of the pack by volume, although the greater fluency of the packs having at least half of the particles with the 45 degree repose angle, are preferred.

It is not necessary to diffusion coat the external surfaces of such tubes or to diffusion coat those external surfaces with aluminum. The internal bores of such tubes can be chromized for instance without the use of a covering layer on their exterior. Such chromizing in the retort arrangement described in Example 2 will produce a distinct outer chromized case in addition to the above-described internal case, but the outer case will generally not show the carbide stratum and will have less chromium pick-up.

The foregoing inner and outer coatings can be applied to tubes as long as 40 feet or more in length, whether those tubes be straight or cane-chaped. For such long tubes it is desirable to effect the diffusion coating uniformly along the tube lengths, and to this end the diffusion coating temperature along the length of the tube can be closely controlled. Thus a plurality of the tubes each with its bore packed and its ends capped can be inserted lengthwise in a tubular open-ended retort sufficiently narrow to make a snug container for the tubes. One or more of the tubes is also fitted with a number of thermocouples on its exterior and distributed along its length. The retort so loaded can then be inserted in a furnace having a number of gas burner rings spaced along the retort's length, each ring encircling the retort. Only one end of the retort need be open, and that end can be sealed with a head that has a number of passageways. Some of these passageways are used for the passage of thermocouple connection wires, and two can be used as inlet and outlet respectively, for a bathing gas such as hydrogen.

The operation of the burner rings is then adjusted to bring all the thermocouples to the desired temperature. Should there be a temperature variation among the thermocouples, individual burners can be further adjusted. In this way a cool thermocouple can have its temperature brought up by turning up the nearest burner or burners, and conversely a hot one can have its temperature reduced by turning down the nearest burner or burners. These control functions can be effected manually or automatically to maintain the temperature of the packed tubes within a range of about 25° F. along their entire lengths.

Cane-shaped tubes can be handled the same way. Also an argon washing atmosphere can be maintained throughout most or all of the diffusion coating of Example without significantly different results. Because of its expense, the flow of argon should be reduced to a very small rate by back pressuring it equivalent to 1 to 2 inches of water. Alternatively, that diffusion can be effected in a glass-sealed retort with an autogenously generated atmosphere.

Any of these retort and retort atmosphere arrangements can also be used with slurry coatings or conventional packs to aluminize nickel, platinum and other metals for the purpose of improving their catalytic activity as described in U.S. Pat. No. 3,867,184. Part of the metal surface can also be masked as by the sheath-forming layer directly applied to those parts. When a nickel surface of high catalytic activity is desired, the nickel is best subjected to diffusion aluminizing in a plurality of stages before the leaching. In the first diffusion stage the activity of the inwardly diffusing aluminum is kept low, as by using an aluminum diffusion pack containing 10 to 40% aluminum, the balance alumina, with a 0.3% $AlCl_3$ energizer added. A diffusion treatment of 1050° to 1100° F. for 20 to 30 hours with such a pack causes the formation of the nickel surface of an aluminized case in which essentially all its aluminum is in the form of $Ni_2Al_3$ intermetallic.

In a subsequent diffusion aluminizing stage the outer portion of the aluminized case is modified to convert the $Ni_2Al_3$ to a higher aluminide of nickel. The aluminizing pack of the first stage can be used in a second stage conducted at a lower temperature, as for example from about 880° to about 920° F., for 20 to 30 hours as an effective technique for converting the aluminide in the outermost portion of the case to higher aluminide.

These two diffusion steps are the only ones needed, and nickel so treated and then leached with 5 to 50% aqueous caustic soda has an exceptionally good catalytic action in hydrogenation reactions such as the hydrogenation of benzene or phenol or coal as in coal gasification. This double diffusion is illustrated in the following example.

EXAMPLE 3

A six-foot square section of nickel screening is solvent degreased, placed in a previously aluminized steel retort containing a mix of 20% Al (40 microns) and 80% $Al_2O_3$ (325 mesh) with ½% $AlCl_3$ distributed throughout the mix. Diffusion coating is effected in $H_2$ at 1050°–1100° F. for 25 hours to provide a 0.006 inch case of primarily $Ni_2Al_3$. The diffusion coating step is then repeated using the same pack mixture as above but this time at a temperature of 850° to 900° F. for 30 hours to provide a predominately $NiAl_3$ 1 mil thick coating on top of the aforementioned $Ni_2Al_3$ coating. The resulting screen is washed, dried, and stored or leached. Treatment with 20% NaOH at room temperature primarily leaches out the Al from the $NiAl_3$ layer with minor effect on the $Ni_2Al_3$ layer when the leaching action has subsided, the screen is washed and immediately placed in a liquid such as cyclohexane to prevent surface oxidation until ready for use. Poorly volatile liquids such as kerosene, or congealable liquids such as melted wax can be used to protect the active surface while the screen is installed in the hydrogenating equipment and can then be washed off. The double diffusion can also be effected on sheet, foil or tubes, as well as on nickel that is plated on a support such as steel with equally good results. In general at least about 1 mil of $Ni_2Al_3$ case should be present in the leached product below the activated surface layer left by the leaching. Also that activated surface layer should be at least about 0.5 mil deep.

The second aluminizing stage can, if desired, be effected by merely extending the time during which the nickel being treated cools down after the completion of the first stage. Thus the furnace heat can be turned on again during the initial cool-down, then the retort temperature reaches about 925° F. and can then hold the desired second stage temperature.

The improved activity resulting from the foregoing dual diffusion is not noticeable when preparing activated platinum by diffusing aluminum into it and then leaching. However activated platinum prepared in this way is more stable and can be exposed to air without loss of activity. Indeed when such activated platinum is used as an igniter for hydrogen, a job it does well at and even below room temperature, it is preferably kept exposed to air when not doing any igniting. It can also be advantageously arranged to be held in a stream of a mixture of air and hydrogen as that stream flows to a hydrogen-burning jet, and in a location relatively close to but upstream from that jet, so that the active platinum assures the ignition of the stream yet remains out of the flame burning at the jet. In such arrangement the dual diffusion of the aluminum is not needed.

Obviously many modifications and variations of the present invention are possible in the light of the above teachings. It is therefore to be understood that within the scope of the appended claims the invention may be practiced otherwise than as specifically described.

What is claimed is:

1. The process of diffusion coating the interior of a ferrous steam boiler tube about 5 to about 40 feet long, including the steps of packing a diffusion coating pack into that interior and then subjecting that interior to diffusion coating conditions, at least about half the introduced pack by volume being fluent particles greater than 100 microns in size and having a repose angle not over about 45 degrees.

2. The combination of claim 1 in which the fluent particles are selected from the class consisting of tabular alumina and microspherical alumina.

3. The combination of claim 1 in which the fluent particles are tabular alumina.

4. The combination of claim 1 in which the tube is cane-shaped.

5. The combination of claim 1 in which the tube is about 40 feet long.

6. The combination of claim 1 in which the diffusion coating is a chromizing operation and the pack is a chromium-containing diffusion-coating powder pack.

7. The combination of claim 6 in which the steam boiler tube is an alloy containing 1.9 to 2.6% chromium, 0.97 to 1.13% molybdenum, 0.15% carbon, the balance being essentially iron.

* * * * *